US008536473B2

(12) United States Patent
Goyal et al.

(10) Patent No.: US 8,536,473 B2
(45) Date of Patent: Sep. 17, 2013

(54) METHOD AND APPARATUS FOR A COMBINATION LIGHT PIPE AND AIR GAP SWITCH

(75) Inventors: Rahul Goyal, Tyrone, GA (US); Oscar Neundorfer, Senoia, GA (US); James Fair, Fayetteville, GA (US); Ahmed Elgayyar, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 250 days.

(21) Appl. No.: 13/073,803

(22) Filed: Mar. 28, 2011

(65) Prior Publication Data

US 2012/0247935 A1 Oct. 4, 2012

(51) Int. Cl.

| | |
|---|---|
| ***H01H 9/26*** | (2006.01) |
| ***H01H 13/72*** | (2006.01) |
| ***H01H 13/76*** | (2006.01) |

(52) U.S. Cl.

USPC ..... 200/5 A

(58) Field of Classification Search

USPC ..... 200/5 A, 5 R, 5 B, 5 C, 317, 286, 200/19.2, 19.13, 33 B, 431, 252, 297, 56 R, 200/61.02, 308, 310–313, 315, 333, 339, 200/296

See application file for complete search history.

(56) References Cited

U.S. PATENT DOCUMENTS

| | | | | |
|---|---|---|---|---|
| 4,783,581 | A * | 11/1988 | Flowers et al. | 200/542 |
| 4,880,950 | A * | 11/1989 | Carson et al. | 200/547 |
| 7,250,580 | B2 * | 7/2007 | Kurek et al. | 200/339 |
| 7,985,937 | B2 * | 7/2011 | Wu et al. | 200/330 |

* cited by examiner

*Primary Examiner* — Edwin A. Leon
*Assistant Examiner* — Anthony R. Jimenez
(74) *Attorney, Agent, or Firm* — King & Spalding LLP

(57) ABSTRACT

An electrical switch device includes a housing, faceplate, and a light pipe assembly that includes a light transmissive channel, a position stop, and a cam. The device also includes an air gap switch having a movable contact assembly and a stationary contact assembly. The movable contact assembly includes a cam follower that engages the cam of the light pipe assembly. The light pipe assembly is configured to pulled outward from the outer surface of the faceplate. Movement of the light pipe assembly cause the cam follower of the movable contact assembly to move along the cam and separate the movable contact from the stationary contact, shorting the circuit. Pushing the light pipe assembly in a direction back into the faceplate causes the cam follower to move in the opposite direction along the cam and allows the movable contact to engage the stationary contact and close the circuit.

20 Claims, 3 Drawing Sheets

METHOD AND APPARATUS FOR A COMBINATION LIGHT PIPE AND AIR GAP SWITCH

TECHNICAL FIELD

The present invention relates generally to electrical wiring devices and more particularly, to dimming devices having an air gap switch.

BACKGROUND

Dimmer switches and electrical dimming devices can include the ability to completely disconnect the power that is provided to the load. The ability to completely disconnect the power may be necessary when maintenance needs to be completed on the load. Examples of maintaining a load can include, but are not limited to, changing a burned-out light bulb or florescent tube.

In conventional dimmer switches, when the dimmer setting is set at the lowest level a load will appear to be completely off. However, in this state there is still a measurable leakage current through the dimmer that may be potentially dangerous. Therefore, conventional dimmers are required to have a mechanical switch to fully open the circuit for purposes of conducting maintenance on the load. This mechanical switch is typically referred to as an air gap switch.

Most conventional air-gap mechanisms use a plastic pull-down switch that protrudes downwardly from the bottom of the switch faceplate. This pull-down switch is oriented parallel with and against the wall. When the circuit is closed, the air-gap actuator is slightly visible below the faceplate. To open the circuit, air-gap actuator is pulled downward or outward. The actuator manipulates a mechanical air-gap switch in response to the movement. Unfortunately this conventional design has several drawbacks, including the fact that the actuator has only one function, is rarely needed yet it is visible and unattractive along its positioning on the faceplate and it when it protrudes from the faceplate.

Furthermore, due to technological advances, changes to local and national codes, and consumer preferences, modern electrical switches need to have more features and additional capabilities. Examples of these features include, occupancy sensing, night lights, ambient light level detection, dimming, dimmer level notification, as well as the numerous types of manually adjustable electrical switches themselves. Individually, the use of one of these features is not problematic. However, as more and more of these features are desired in a single switching device, the amount of space to provide for these features on the faceplate of the switch is increasingly restricted. The ability to combine one or more features with the air gap switch and also possible hiding the air gap switch along the faceplate would provide increased flexibility and consumer satisfaction.

SUMMARY

A novel electrical switch includes an adjustable light pipe assembly that activates an air gap switch is shown and described herein. In one exemplary embodiment, an electrical switch can include a faceplate having an outer surface. The switch can also include a light pipe that can be configured to move in a substantially orthogonal direction from the outer surface of the faceplate from a first position to a second position. The light pipe can include a first end and a second distal end. In the first position, the first end of the light pipe can be positioned along the outer surface of the faceplate. In the second position the first end of the light pipe can extend out from the outer surface of the faceplate. The switch can also include an air gap switch that can be adjusted in response to movement of the light pipe. The air gap switch can include two or more contacts that are configured to open and close a circuit.

In an alternative embodiment, a method of manipulating an air gap switch can include the step of providing a switch device. The switch device can include a housing, faceplate, light pipe assembly, and an air gap switch. The faceplate can be coupled to the housing and can include an outer surface and a longitudinal axis. The light pipe assembly can include a light transmissive channel that can include a first end positioned along the outer surface of the faceplate and a second end distal from the first end. The light pipe assembly can also include a cam. The air gap switch can be positioned within the housing and can include a movable contact assembly and a stationary contact. The movable contact assembly can include a movable contact and a cam follower. The method can further include moving the light pipe assembly in a first direction that can cause the at least a portion of the light transmissive channel to extend outward from the faceplate in a substantially orthogonal direction from the longitudinal axis of the faceplate. The method can also include the cam follower engaging the cam and separating the movable contact from the stationary contact in response to the movement of the light pipe assembly.

These and other inventive concepts will be discussed herein below. The description hereinabove is not intended to be limiting in any manner and is simply a brief overview of some of the novel features of the present disclosure.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
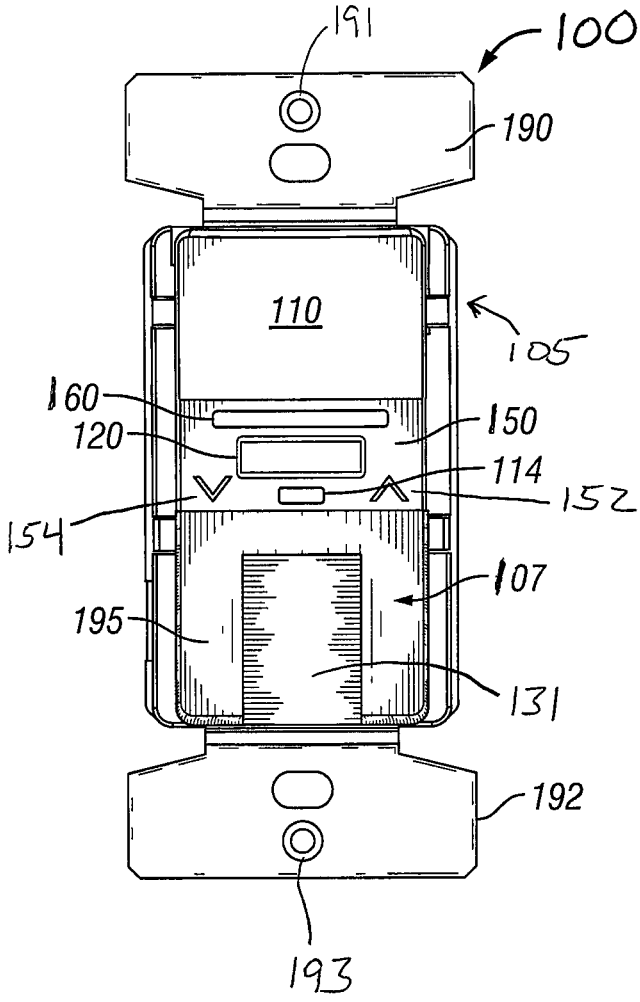
FIG. 1 is a front elevation view of a dimmer switch in accordance with an exemplary embodiment.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

One exemplary embodiment of the present invention is directed to a dimmer switch that includes a light pipe that both emits light generated by an LED and functions as an air gap switch to remove power from the dimmer switch. The end of the light pipe is designed to be flush with or substantially flush with the exterior of one of the switches, such as the dimmer switch 150 of FIG. 1, such that the full frontal appearance of the entire assembly (with the light pipe/air gap switch in the "on" position and the internal air gap switch closed, is that of a substantially smooth, uncluttered surface. When the light pipe/air gap switch is in the "on" (normally closed) position, the dimmer is electrically enabled, allowing a user to operate the dimmer by activating the main actuator to switch power on or off to a load. When the light pip/air gap switch is in the extended/"off" position, the dimmer is electrically disabled. Although the description of exemplary embodiments is provided below in conjunction with the dimmer switch, alternate embodiments of the invention are applicable to other types of electrical wiring devices that either emit LED light, sense ambient light adjacent to the device, or include an infrared (IR) sensor and transmitter and/or receiver so that the device is capable of communicating with an external IR controller for remote operation of the device. These types of devices include, but are not limited to, receptacles, switches, and any other electrical wiring device known to people having ordinary skill in the art. The invention is best understood by reading the following description of non-limiting, exemplary embodiments with reference to the attached drawings, wherein like parts of each of the figures are identified by like reference characters, and which are briefly described as follows.

FIG. 1 is a front elevation view of an in-wall dimmer switch 100 in accordance with an exemplary embodiment of the present invention. Referring to FIG. 1, the exemplary in-wall dimmer switch 100 has a rectangular or substantially rectangular shape and includes an upper coupling band 190, a lower coupling band 192, a housing 105, and a faceplate 107. While the exemplary dimmer switch 100 is described as having a rectangular shape, in alternative embodiments, the switch 100 is capable of being configured in any other geometric or non-geometric shape.

Figure 2:
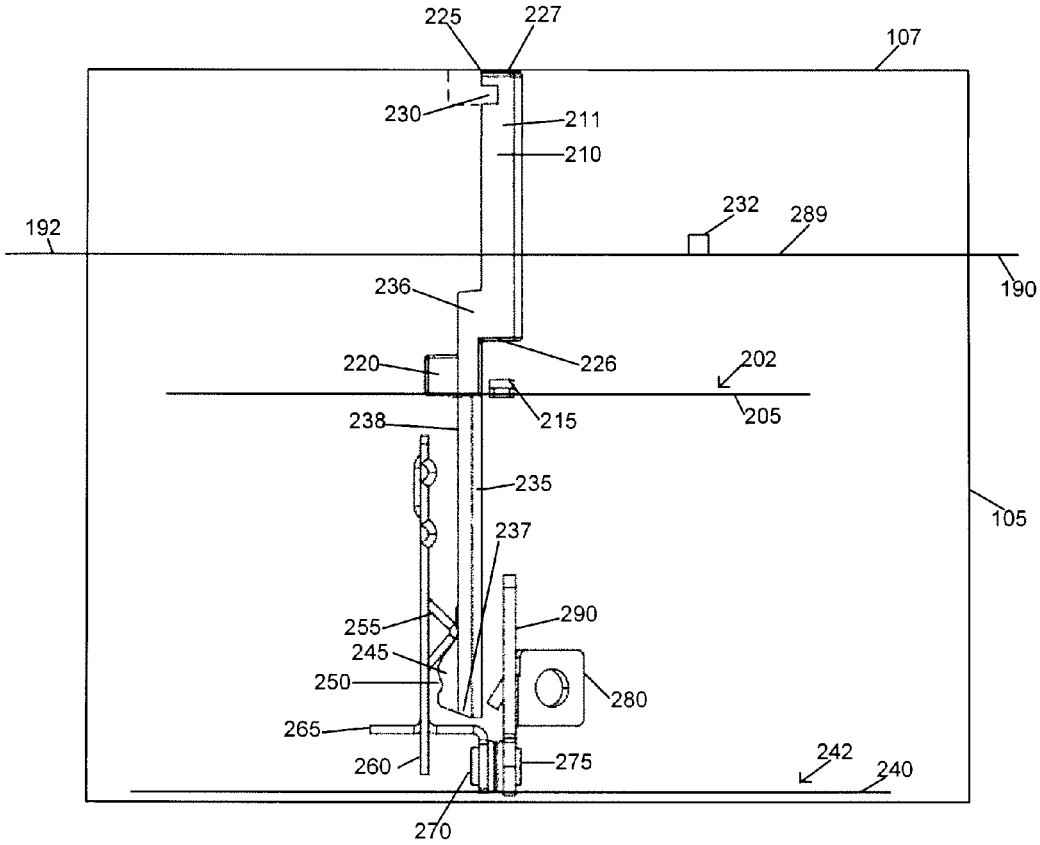
FIG. 2 is a cross-sectional view of combination light pipe and air gap switch of the dimmer switch of FIG. 1 with the contacts in a closed position in accordance with an exemplary embodiment.

The upper coupling band 190 and the lower coupling band 192 are integrally formed with one-another and with a mounting plate 289 (FIG. 2). A portion of the mounting plate 289 is disposed along the perimeter of the faceplate 107 and another portion is disposed between the housing 105 and the faceplate 107. In an alternative embodiment, the upper coupling band 190, the lower coupling band 192, and optionally the mounting plate 289 are formed separately and individually coupled between the housing 105 and the faceplate 107. The upper coupling band 190 and the lower coupling band 192 extend lengthwise out from the faceplate 107 and collectively extend beyond one dimension of the faceplate 107 in both directions. The upper coupling band 190 includes an aperture 191 and the lower coupling band 192 includes an aperture 193. These apertures 191 and 193 are used to couple the in-wall dimmer switch 100 to a wall box (not shown) and are configured to receive a screw (not shown) or other fastening device known to people having ordinary skill in the art therethrough. The exemplary upper and lower coupling bands 190, 192 and mounting plate 289 are fabricated using a metal, such as steel. However, in alternative embodiments the bands 190, 192 and mounting plate 289 are capable of being fabricated using other materials known to people having ordinary skill in the art.

In one exemplary embodiment, the housing 105 is removably coupled to either the mounting plate 289 or at least one of the upper and lower coupling bands 190, 192. The exemplary housing 105 has a substantially rectangular shape. In alternative embodiments, the housing 105 is capable of being formed in other geometric or non-geometric shapes. In certain exemplary embodiments, the housing 105 includes electrical components. Some of these electrical components are shown and described with reference to FIGS. 2 and 3 herein below. Exemplary electrical components include electrical contacts, for electrically coupling the dimmer switch 100 to building wires (not shown) and to load wires (not shown) that are electrically coupled to an associated load (not shown). The exemplary housing 105 is dimensioned to fit within the wall box. In certain exemplary embodiments, the housing 105 is fabricated using a non-conductive material, such as plastic. However, the housing 105 is capable of being fabricated using other materials known to those having ordinary skill in the art according to other exemplary embodiments.

In one exemplary embodiment, the faceplate 107 is removably coupled to the mounting plate 289 (FIG. 2). Alternatively, the faceplate 107 is capable of being removably coupled to at least one of the upper and lower coupling bands 190, 192, and the housing 105. The faceplate 107 remains visible to an end-user once the dimmer switch 100 is installed within the wall box. The exemplary faceplate 107 has a substantially rectangular shape. In alternative embodiments, the faceplate 107 is capable of being formed in other geometric or non-geometric shapes. In one exemplary embodiment, the faceplate 107 has a profile that is substantially similar to the profile of the housing 105 and is disposed over the housing 105 and all or at least a portion of the mounting plate 289. The faceplate 107 includes, for example, an occupancy sensor window 110, a night light 120, a dimmer switch 150, a dimmer level indicator 160, and a manually operable switch 195. In other exemplary embodiments, the night light 120, dimmer level indicator 160, occupancy sensor window 110, and/or manually operable switch 150 are optionally removable from the faceplate 107. According to one exemplary embodiment, the night light 120 is disposed adjacent the occupancy sensor window 110 and the manually operable switch 195, such as, for example, being positioned between the occupancy sensor window 110 and the manually operable switch 195. In one exemplary embodiment, the occupancy sensor window 110 is positioned along the top portion of the faceplate 107 and the manually operable switch 195 is positioned along the bottom portion of the faceplate 107. In one exemplary embodiment, the occupancy sensor window is a Fresnel lens 113 that is positioned on a portion of the in-wall dimmer switch 100. Although the positioning for the occupancy sensor window 110, the night light 120, and the manually operable switch 195 has been provided in accordance with one of the exemplary embodiments, other exemplary embodiments having alternative positioning for one or all of the components is within the scope and spirit of this disclosure.

While the exemplary dimmer switch 150 of FIG. 1 is presented as a rocker-style switch, the dimmer switch 150 is capable of being any type of dimmer switch known to those of ordinary skill in the art including, but not limited to, slide-style switches, touchpads, rotary dimmer switches and the like. Manual adjustment of the dimmer switch 150 allows a user to adjust the amount of voltage across the load (not shown). For example, depressing the "up dimming" side 152 of the dimmer switch 150 will increase the amount of voltage across the load. Conversely, depressing the "down dimming" side 154 of the dimmer switch 150 will decrease the amount of voltage across the load. In one exemplary embodiment, the dimmer switch 150 is disposed on the faceplate between the occupancy sensor window 110 and the manually operable switch 195. In alternative embodiments, the faceplate 107 does not include the manually operable switch 195 and instead only includes the dimmer switch 150 for adjusting power to the load. The dimmer level indicator 160 presents a visual indication of the level the dimmer switch 150 is operating at. In one exemplary embodiment, the dimmer level indictor 160 includes a translucent or transparent window and multiple LEDs capable of emitting light in one or more colors through the window. In this exemplary embodiment, the dimmer level indicator 160 is positioned on the faceplate 107 adjacent to the dimmer switch 150 and below the occupancy sensor window 110.

The exemplary dimmer switch 100 also includes a load status window 114. The load status window 114 is located adjacent to the night light 120 and the dimmer switch 150. Alternatively, the load status window 114 is capable of being positioned anywhere on the dimmer switch 100 so long as the load status window 114 is visible to a user once the in-wall dimmer switch 100 is installed within the wall box. The load status window 114 is capable of receiving a light pipe assembly, light pipe channel, or light pipe cap discussed in greater detail with regard to FIGS. 2 and 3 below.

In versions where the exemplary switch 100 includes a night light 120, the night light 120 includes one or more LEDs (not shown), or LED packages. Although LEDs are described in the exemplary embodiment, other light sources known to people having ordinary skill in the art including, but not limited to, organic light emitting diodes ("OLEDs") and liquid crystal display ("LCD") screens, are used in alternative exemplary embodiments without departing from the scope and spirit of the exemplary embodiment. In certain exemplary embodiments, the night light 120 also optionally includes a lens 122 positioned over the LEDs or LED packages. The night light LEDs emit substantially white light having a color temperature between 2500 and 5000 degrees Kelvin. However, in alternative exemplary embodiments, the night light 120 emits any color of light at various intensities of that color. The lens 122 is fabricated using an optically transmissive or clear material. In certain exemplary embodiments, the lens 122 provides environmental protection while transmitting light from the LEDs.

In certain exemplary embodiments, the lens 122 is a push-button lens that is used to turn on and off the night light 120 and/or dim the night light 120. The exemplary push-button lens is substantially rectangular; however, other geometric or non-geometric shapes for the lens are capable without departing from the scope and spirit of this disclosure. In certain exemplary embodiments, when the night light 120 turns on, the LEDs emit light through the lens 122. When the night light 120 is dimmed, the intensity of the light emitted from the LEDs through the lens 122 is varied or the number of LEDs that are on is varied according to manufacturing desires. For example, the light intensity emitted from the night light 120 is varied by increasing or decreasing the power supplied to the LEDs. In another example, if the night light 120 includes ten LEDs, the number of LEDs that emit light can be increasingly or decreasingly varied from one LED to ten LEDs or ten LEDs to one LED to produce a dimming effect.

In this exemplary embodiment, the lens 122 in pushed in and released to turn on and off the night light 120. Once the night light 120 is on, the lens 122 is pushed in and held in to achieve dimming of the night light 120. For example, once the night light 120 is turned on, the night light 120 emits light at its maximum intensity. The lens 122 is pushed in and held in to decrease the light intensity emitted from the night light 120 until the desired intensity is reached, at which time the end-user releases the lens 122. If the end-user desires to increase the intensity of the light emitted from the night light 120, the lens 122 is again pushed in and held in until the desired intensity is reached. In another embodiment, the night light 120 operation is the same, except that once the night light 120 is turned on, the night light 120 emits light at a pre-set intensity, which is set by the end-user and is between the maximum intensity and the minimum intensity. For example, the pre-set intensity is the intensity of the light that the night light 120 emitted immediately before being previously turned off. Thus, according to one exemplary embodiments, the lens 122 of the night light 120 is used to control the operation of the night light 120. In an alternate exemplary embodiment, the lens 122 is repeated tapped to increase or decrease the intensity of the light emitted through the night light 120.

Figure 3:
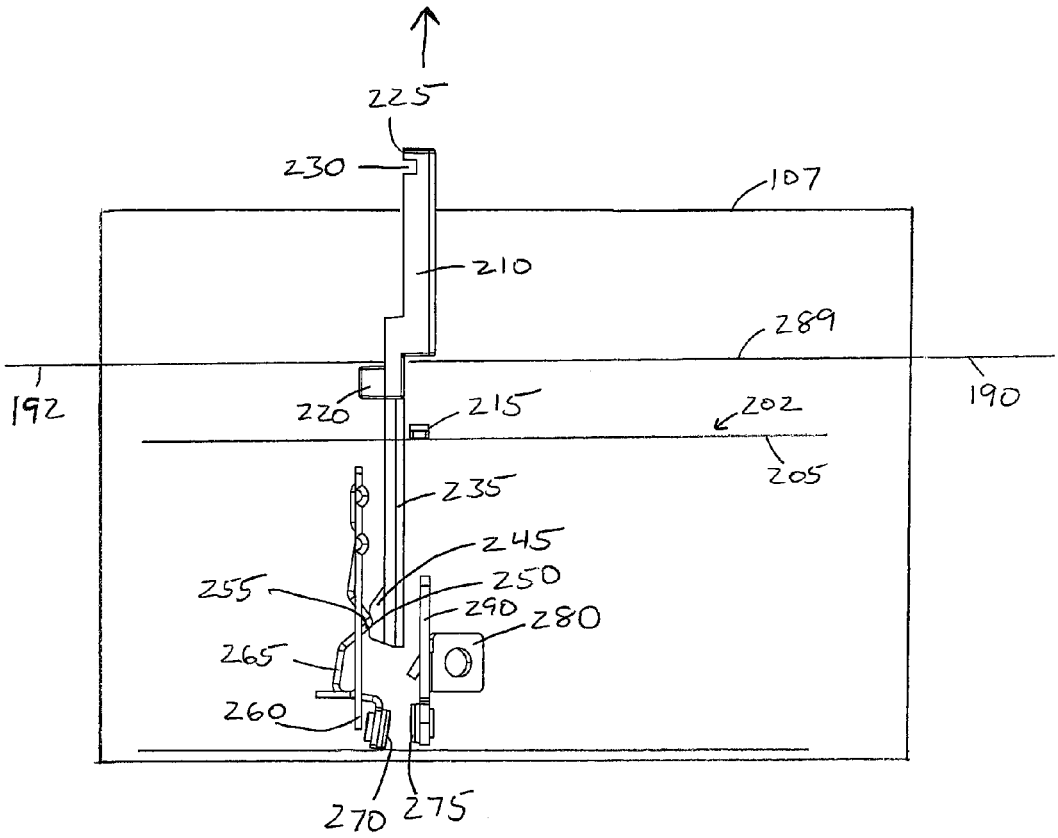
FIG. 3 is a cross-sectional view of combination light pipe and air gap switch of the dimmer switch of FIG. 1 with the contacts in an open position in accordance with an exemplary embodiment.

FIGS. 2 and 3 are cross-sectional views of certain internal components of the dimmer switch 100 of FIG. 1 in accordance with an exemplary embodiment. Now referring to FIGS. 1-3, the housing 105 of the dimmer switch 100 includes a first printed circuit board (PCB) assembly 240 disposed generally near a bottom end of the housing 105 and a second PCB assembly 205 positioned above the first PCB assembly 240. Each PCB assembly 205, 240 includes a printed circuit board (PCB) defining a perimeter. The first PCB assembly 240 includes a top surface 242 and the second PCB assembly 205 includes a top surface 202.

An exemplary light pipe assembly 210 includes an elongated channel member that includes a first end 226 with a first aperture, a second end 227 with a second aperture opposite from and distal of the first, and a channel 211 connecting the first and second ends 226, 227 such that a pathway through the light pipe 210 is created. In certain exemplary embodiments, the second aperture is covered by a light transmissive cap 225. The light transmissive cap 225 can be clear, transparent, or translucent with a colored tint. The first end 226 of the light pipe 210 is disposed near or adjacent to the top surface 202. The light pipe 210 extends up from near the top surface 202 of the second PCB assembly 205 such that a portion of the light transmissive cap 325 is disposed along the surface of or extends through the faceplate 107.

A light source, such as, for example, an LED 215 is electrically coupled to the top surface 202 of the second PCB assembly 205. In one exemplary embodiment, power for the LED 215 is supplied through traces (not shown) on the second PCB assembly 205. The LED 215 is typically positioned adjacent to the first end 226 of the light pipe 210 so that light transmitted by the LED 215 is received by the light pipe 210 at the first end 226 transmitted through the channel 211 and emitted out of the second end 227. In alternative exemplary embodiments, the LED 215 is replaced with a light sensor or IR sensor (not shown).

The emission of light (or lack thereof) by the LED, LED chip on board, or LED package 215 provides information to the end-user as to the load status, whether motion has been detected in the monitored area, and/or the location of the switch 100. In one exemplary embodiment, the LED 215 emits a visible constant light at or near full intensity when a load associated with the in-wall dimmer switch 100 is on and emits a dimmed level of light when the load associated with the in-wall dimmer switch 100 is off. Also, in certain exemplary embodiments, the LED 215 emits a momentary flashing light when motion is detected within the monitored area and emits no light when motion is not detected within the monitored area. In alternative exemplary embodiments, other methods, such as using two or more independent LEDs or LED packages, can be used to show the load status or whether motion has been detected within the monitored area. In this alternative embodiment, for example, one LED or LED package indicates the load status while the second LED or LED package indicates whether motion has been detected in the monitored area. Distinguishing between the two could be accomplished by having each LED emit a different color of light through the light pipe 210.

In certain exemplary embodiments, an optically transmissive or clear material (not shown) encapsulates at least a portion of each LED or LED package 215. This encapsulating material provides environmental protection while transmitting light from the LEDs 215. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating a desired light color.

For the alternative embodiments that include a light sensor (not shown), one or more light sensors are electrically coupled to the top surface 202 of the second PCB assembly 205. In one exemplary embodiment, the light sensors are coupled to the second PCB assembly 205 and are disposed adjacent to the first end 226 of the light pipe 210. In this exemplary embodiment, the light sensors receive ambient light from an area adjacent to and external to the switch 100 by the ambient light being transmitted through the cap 225 on the second end 227 of the light pipe 210, through the channel 211, and through the first end 226 of the light pipe 210 to the light sensor. Exemplary light sensors include a photocell, a photosensitive resistor, and/or a phototransistor.

For the alternative embodiments that include an IR sensor (not shown), one or more IR sensors are electrically coupled to the top surface 202 of the second PCB assembly 205, disposed adjacent to the first end 226 of the light pipe 210, and communicably coupled to a remote control transceiver or microcontroller (not shown) also disposed along one of the first and second PCB assemblies 205, 240. In this exemplary embodiment, the IR sensor receives IR control signals from a master control device or remote control device by the IR control signals being transmitted through the cap 225, through the channel 211, and through the first end 226 of the light pipe 210 to the IR sensor.

The second PCB assembly 205 also includes an occupancy sensor 232 electrically coupled to the top surface 202 of the second PCB assembly 205. The occupancy sensor 232 senses occupancy through the occupancy sensor window 110 in the monitored area and sends a signal to energize a load, maintains a signal to energize the load when sensing continuing occupancy of the monitored area, and enables settings for operating the occupancy sensor 232. According to some exemplary embodiments, the occupancy sensor 232 includes one or more passive infrared ("PIR") sensors (not shown). Although the exemplary occupancy sensor 232 includes PIR sensors, in alternative embodiments, the occupancy sensor 232 includes any one or a combination of different occupancy sensing technologies including, but not limited to, PIR, ultrasonic, microwave, and microphonic technologies in other exemplary embodiments.

According to one exemplary embodiment, the occupancy sensor 232 using the PIR sensors to detect occupancy, passively senses the occupancy of the monitored area through the window 110, generates a signal upon detecting occupancy, and continues generating the signal upon sensing the continuing occupancy of the monitored area. In certain exemplary embodiments, when the occupancy sensor 232 generates the signal based upon detecting motion, the associated load is turned on (if the manually adjustable switch 195 is in a position designating that the load should be energized). The exemplary occupancy sensor 232 utilizes a passive technology that does not send out a signal to aid in the reception of a signal. However, in certain alternative exemplary embodiments, the occupancy sensor 232 utilizes an active technology, such as ultrasonic technology, or a combination of active and passive technologies.

In certain exemplary embodiments, the occupancy sensor 232 transmits one or more signals to the microcontroller so that the microcontroller is able to determine occupancy within a desired monitored area. In these exemplary embodiments, the occupancy sensor 232 automatically sends a signal to the microcontroller at predetermined time intervals, at random time intervals, or only when occupancy is detected. Alternatively, the microcontroller polls the occupancy sensor 232 for the occupancy detection sensor 232 to send a signal back to the microcontroller. The microcontroller is able to poll the occupancy sensor 232 automatically at predetermined time intervals or at random time intervals.

The exemplary light pipe assembly 210 also includes a slot 230, indentation, or area without material adjacent to or just below the cap 225 and along the channel 211. The slot 230 is sized and shaped to receive a fingernail, portion of a finger, or small thin object therein to pry the light pipe assembly 210 upward from the surface of the faceplate 107. Coupled along the channel 211 adjacent the first end 226 is an elongated member 235. The elongated member 235 extends downward from the channel 210 and has a longitudinal axis that is in a parallel or substantially parallel plane to the longitudinal axis of the channel 211. The elongated member 235 is coupled at a first end 236 to the channel 211 and extends from the channel 211 through an aperture in the second PCB assembly 205 and further extends toward the first PCB assembly 240. The elongated member includes a distal second end 237. Along a surface 238 of the elongated member 235 near or adjacent to the second 237, the elongated member includes a cam 245. The cam is configured to engage a cam follower 255 on a movable switch 260 to separate a movable contact 270 from a stationary contact 275. The cam 245 includes a detent 250 that the cam follower 255 engages and come to rest therein to maintain the contacts in an open configuration resulting in a short in the circuit.

The exemplary elongated member 235 also includes a position stop member 220 coupled to the elongated member. In one exemplary embodiment, the position stop member 220 extends orthogonally or substantially orthogonally outward from the longitudinal axis of the elongated member 235 and is positioned along the surface 238 of the elongated member 235 near the first end 236. The position stop 220 is sized and shaped so as to not fit through the aperture of the second PCB assembly 205 that the elongated member 235 extends through and to not fit through the aperture in the mounting plate 289 that the light pipe 210 and the first end 236 of the elongated member 235 fits through. In one exemplary embodiment, the position stop 220 is configured to engage the second PCB assembly when the light pipe 210 is in a first position, where the circuit is closed, and to engage the mounting plate 289 when the light pipe assembly 210 is in a second position having at least a portion extending out form the surface of the faceplate 107, where the circuit is shorted.

The exemplary air gap assembly includes the movable contact assembly 260 and the stationary contact assembly 290. The exemplary movable contact assembly 260 includes an elongated member that includes the cam follower 255 extending orthogonally or substantially orthogonally outward therefrom. The exemplary cam follower 255 is constructed of two adjoining members in a substantially "V" shaped formation with the members intersecting at an apex of the distance away from the elongated member of the movable switch 260. While the exemplary cam follower 255 is V-shaped, other shapes and types of cam-followers known to those of ordinary skill in the art may be substituted without affecting the operation of the exemplary device 100. The movable switch 260 also includes a contact mount 265. In one exemplary embodiment, the contact mount 265 extends orthogonally or substantially orthogonally from the elongated member of the movable switch 260. The contact mount 265 is coupled to the movable contact 270. In one exemplary embodiment, the movable contact 270 extends orthogonally or substantially orthogonally from the contact mount 265. In certain exemplary embodiments, the movable contact assembly 260 is electrically coupled to the first PCB assembly 240 along the surface 242. In addition, in certain exemplary embodiments, the movable contact assembly 260 is mechanically coupled to the first PCB assembly 240.

The exemplary stationary contact assembly 290 includes an elongated member 290. In one exemplary embodiment, the elongated member 290 has a longitudinal axis that is on a parallel plane with a longitudinal axis of the elongated member of the movable contact assembly 260. The stationary contact assembly 290 also includes a lead contact 280 electrically coupled to the stationary contact assembly 290. In one exemplary embodiment, the lead contact 280 is also mechanically coupled to the stationary contact assembly 290 along the elongated member 290. The lead contact 280 is configured to electrically couple a wire or lead to the switch assembly 290. The stationary contact assembly 290 also includes a stationary contact 275. In one exemplary embodiment, the stationary contact 275 is coupled along one end of the elongated member 290. In certain exemplary embodiments, the stationary contact assembly 290 is electrically coupled to the first PCB assembly 240 along the surface 242. In addition, in certain exemplary embodiments, the stationary contact assembly 290 is mechanically coupled to the first PCB assembly 240.

In one exemplary embodiment, the air gap switch is opened, resulting in a short in the circuit by engaging the slot 230 of the light pipe 210 with a fingernail or small device and prying the light pipe outward in an orthogonal or substantially orthogonal manner from the faceplate 107. In certain exemplary embodiments, the air gap switch is a multi-terminal normally closed switch which makes a conductive path across its terminals when it is in the "on" (closed) position and breaks the conductive path when it is in the disconnected "off" (open) position. The air gap switch is typically coupled in series with the manually operable switch 195 so that when the air gap switch is in the "on" position, the manually operable switch 195 and the dimmer switch 150 are enabled, allowing a user to operate the dimmer 100. On the other hand, when the air gap switch is in its disconnected "off" position, electrical power is disconnected from the dimmer so that the manually operable switch 195 and the dimmer switch 150 are disabled, preventing a user from operating the dimmer 100 thereby also preventing the user from activating the load electrically coupled to the dimmer 100.

As the light pipe 210 continues to be moved outward from the faceplate 107, the cam 245 moves in a direction from the first PCB assembly 240 towards the second PCB assembly 205. As the cam 245 moves, the cam follower 255 engages the cam 245 and moves along the cam 245. The movement of the cam follower 255 along the cam 245 causes a corresponding movement in the elongated member 260 of the movable contact assembly 260 the contact mount 265 and the movable contact 270 thereby separating the contacts 270, 275 and creating a short in the circuit for the device 100 or the dimmer portion of the device. As the light pipe 210 continues to be moved outward from the faceplate 107, the position stop 220 hits or engages the mounting plate 289 or other stopping member and prevents the light pipe 210 from being pulled further outward. Also, as the position stop 220 is hitting the mounting plate 289 or other stopping member, the cam follower 255 enters or is in the detent 250 of the cam 245. The cam follower 255 resting in the detent 250 allows the cam follower 255 to stay in that position, with the contacts 270, 275 still open until a subsequent force is applied to the light pipe 210. With the contacts 270, 275 separated, the power to the load is prevented and the user is safe to conduct maintenance on the load.

When a user wants to resume normal operation for the load, the light pipe 210 is pushed back in an orthogonal or substantially orthogonal manner to the longitudinal axis of the faceplate 107 towards the housing. The movement of the light pipe assembly 210 causes a corresponding movement of the cam 245. As the cam 245 moves in a direction most easily defined as from the second PCB assembly 205 towards the first PCB assembly 240, the cam follower 255 moves out of the detent 250 and along the cam 245. When the light pipe assembly 210 is pushed all the way back in, such that it is flush with or substantially flush with the surface of the faceplate 107, the position stop 220 optionally engages the second PCB assembly 205 or other stop member to prevent further movement of the light pipe 210 assembly inward. The cam 255 moves to one end of the cam follower 245 causes a corresponding movement in the elongated member 260 of the movable contact assembly 260, the contact mount 265, and the movable contact 270 thereby allowing the exemplary normally closed contacts 270, 275 to re-engage one another and complete the circuit for the device 100 or the dimmer portion of the device. While the exemplary embodiment described above teaches the contact 275 with the lead mount 280 as being stationary and the other contact assembly 260 being movable the operations of each could be switched and is within the scope of this disclosure.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An electrical switch device configured to be electrically coupled to a load and comprising:

a faceplate having an outer surface;

a light pipe comprising:

a light transmissive channel having a first end disposed adjacent to the outer surface of the faceplate and a distal second end, and configured to extend out from the outer surface of the faceplate from a first position to a second position, wherein in the first position, the first end is substantially flush with the outer surface of the faceplate, and wherein in the second position, the first end protrudes beyond the outer surface of the faceplate;

an air gap switch comprising at least two contacts configured to close a circuit, wherein the air gap switch is mechanically engaged with the light pipe, wherein movement of the light transmissive channel from the first position to the second position adjusts the air gap switch from a closed position, wherein the contacts are engaged, to an open position wherein the contacts are separated and the circuit is open; and a secondary switch disposed along the surface of the faceplate and configured to be manually adjustable to operatively control a load electrically coupled to the electrical switch.

2. The electrical switch device of claim 1, wherein the light pipe further comprises:

an elongated member coupled adjacent to the second end of the light pipe; and a cam disposed along a surface of the elongated member.

3. The electrical switch device of claim 2, wherein the elongated member further comprises a position stop disposed along the surface of the elongated member, the position stop configured to limit movement of the light pipe in at least one direction.

4. The electrical switch device of claim 2, wherein the elongated member is configured to have a corresponding movement with the light pipe to move the cam in a direction substantially orthogonal to the faceplate.

5. The electrical switch device of claim 2, wherein the cam comprises a detent disposed between a first end of the cam and a second end of the cam, the detent configured to receive a cam follower.

6. The electrical switch device of claim 2, wherein the air gap switch further comprises:

a movable contact assembly; and a stationary contact assembly having a stationary contact.

7. The electrical switch device of claim 5, wherein the movable contact assembly comprises:

a member;

a cam follower coupled to the member and configured to engage the cam along a range of motion; and a movable contact;

wherein the movable contact assembly is configured to adjust the movable contact between the closed and open positions.

8. The electrical switch device of claim 7, wherein the cam follower is substantially V-shaped and extends substantially orthogonal to a longitudinal axis of the member.

9. The electrical switch device of claim 1, further comprising one of a light emitting source, a light sensor, and an infrared sensor disposed near the second end of the light pipe.

10. The electrical switch device of claim 1, further comprising a dimmer switch disposed along the faceplate and electrically coupled to the air gap switch.

11. A method for manipulating an air gap switch comprising the steps of:

providing a switch device comprising;

a housing a faceplate coupled to the housing and having an outer surface;

a light pipe assembly comprising:

a light transmissive channel having a first end disposed adjacent to the outer surface of the faceplate and a distal second end; and an air gap switch disposed within the housing and comprising:

a movable contact assembly;

a stationary contact;

moving the light pipe assembly from the first position to the second position, wherein in the first position, the first end of the light transmissive channel is flush with the outer surface of the faceplate, and wherein in the second position, the first end of the light transmissive channel protrudes beyond the outer surface of the faceplate;

in response to moving the light pipe assembly from the first position to the second position, separating the movable contact from the stationary contact.

12. The method of claim 11, wherein providing a switch device further comprises:

providing a stopping member disposed within a cavity defined by the faceplate and the housing; and providing a printed circuit board assembly within the housing;

wherein providing a light pipe assembly further comprises:

providing an elongated member coupled to the light transmissive channel adjacent to the second distal end;

providing a position stop coupled to the elongated member; and wherein the method further comprises engaging the stopping member with the position stop to limit the movement of the light pipe in the first direction.

13. The method of claim 12, wherein the stopping member comprises a mounting plate disposed at least partially between the faceplate and the housing.

14. The method of claim 12, wherein the cam further comprises a detent disposed along the surface of the cam and wherein when the position stop engages the stopping member, the cam follower is positioned within the detent of the cam.

15. The method of claim 11, further comprising the steps of:

moving the light pipe assembly in a second direction opposite the first direction;

in response to the movement of the light pipe assembly in the second direction, moving the cam follower out of the detent of the cam and along the surface of the cam follower;

stopping the movement of the light pipe assembly in the second direction at a second position;

allowing the movable contact to engage the stationary contact when the light pipe assembly is at the second position.

16. The method of claim 15, wherein the movement of the light pipe assembly in the second position is stopped by the position stop engaging a portion of the PCB assembly.

17. An electrical dimming device comprising;

a housing a faceplate coupled to the housing, the faceplate comprising an outer surface and a plane parallel to the outer surface, wherein the faceplate and the housing define a cavity;

a dimmer switch disposed at least partially adjacent the outer surface of the faceplate;

a light pipe assembly comprising:

a light transmissive channel having a first end disposed adjacent to the outer surface of the faceplate and a distal second end;

an elongated member coupled to the light transmissive channel adjacent to the second end and substantially orthogonal to the plane of the faceplate; and a cam disposed along the elongated member and orthogonal to the plane of the faceplate;

wherein the light pipe assembly is configured to be slidably adjustable in a direction substantially orthogonal to the plane of the faceplate from a first position with the first end of the light transmissive channel disposed adjacent to the outer surface of the faceplate to a second position with at least a portion of the light transmissive channel extending outward in the substantially orthogonal direction from the outer surface of the faceplate;

an air gap switch disposed within the housing and comprising:

a movable contact assembly comprising:

a cam follower having at least a portion in contact with the cam along a range of motion;

a movable contact configured to move in response to the movement of the cam follower along the cam;

a stationary contact.

18. The electrical dimming device of claim 17 further comprising:

a stop member disposed within the cavity; and a position stop coupled to the light pipe assembly and configured to contact the stop member when the light pipe assembly is slidably adjusted from the first position to the second position.

19. The electrical dimming device of claim 17 further comprising a light emitting diode disposed adjacent to the second end of the light transmissive channel.

20. The electrical dimming device of claim 17, wherein the cam further comprises a detent disposed along a surface of the cam.

* * * * *